US008146737B2

(12) United States Patent
D'Agostino

(10) Patent No.: US 8,146,737 B2
(45) Date of Patent: Apr. 3, 2012

(54) BEVERAGE CUP CARRIER

(76) Inventor: Robert J. D'Agostino, New London, CT (US)

( * ) Notice: Subject to any disclaimer, the term of this patent is extended or adjusted under 35 U.S.C. 154(b) by 295 days.

(21) Appl. No.: 12/320,605

(22) Filed: Jan. 30, 2009

(65) Prior Publication Data

US 2009/0194437 A1 Aug. 6, 2009

Related U.S. Application Data

(60) Provisional application No. 61/063,127, filed on Feb. 1, 2008.

(51) Int. Cl.
*B65D 75/00* (2006.01)

(52) U.S. Cl. ..... 206/162; 206/427; 206/549

(58) Field of Classification Search ..... 206/217, 206/549, 203, 510, 564, 162, 557, 562, 563, 206/427; 229/406, 407; 294/146, 159, 27.1; 220/771

See application file for complete search history.

(56) References Cited

U.S. PATENT DOCUMENTS

| | | | | | |
|---|---|---|---|---|---|
| 2,802,597 | A | | 3/1955 | Davis | |
| 3,055,542 | A | * | 9/1962 | Russo | 206/163 |
| 3,565,323 | A | | 2/1971 | Katzenmeyer | |
| 3,587,915 | A | * | 6/1971 | Theobald | 206/201 |
| D236,575 | S | * | 9/1975 | Vingue | D7/553.4 |
| 3,991,879 | A | * | 11/1976 | Hirota | 206/203 |
| 4,208,006 | A | * | 6/1980 | Bixler et al. | 229/406 |
| D256,434 | S | * | 8/1980 | O'Donnal | D3/309 |
| 4,218,008 | A | | 8/1980 | Veilleux | |
| 4,381,847 | A | * | 5/1983 | Bessett et al. | 229/406 |
| D280,669 | S | * | 9/1985 | Hammeke | D3/308 |
| D280,773 | S | * | 9/1985 | Addy et al. | D3/309 |
| D302,122 | S | * | 7/1989 | Ashby | D7/553.5 |
| D314,279 | S | * | 2/1991 | Hotchkiss | D3/309 |
| 5,096,065 | A | * | 3/1992 | Vigue | 206/564 |
| 5,609,379 | A | * | 3/1997 | Harrelson | 294/87.2 |
| 5,713,619 | A | * | 2/1998 | DuBois et al. | 294/159 |
| 5,803,264 | A | | 9/1998 | Gersten | |
| 5,833,056 | A | | 11/1998 | Goldman | |
| D405,006 | S | * | 2/1999 | Spencer | D9/753 |
| 6,039,205 | A | * | 3/2000 | Flink | 220/659 |
| 6,076,876 | A | * | 6/2000 | Letourneau et al. | 294/143 |

(Continued)

*Primary Examiner* — David Fidei
(74) *Attorney, Agent, or Firm* — Mark E. Pochal

(57) ABSTRACT

A disposable beverage cup carrier is preferably made from molded pulp, plastic or other resilient material capable of withstanding the force of four filled beverage cups while carried by integral carrying handle and preventing collapsing of the carrier and resultant spillage of the hot or cold beverage. The beverage cup carrier has a top surface, generally square in shape, of sufficient diameter capable of accommodating a integral ergonomically carrying handle. The beverage cup carrier is capable of holding one to four cups of various sizes and shapes of beverage containers providing a safe and sturdy means during transportation preventing spillage. The integral carrying handle positioned in the center of the top surface allows the user to carry up to four beverage containers with one hand providing enhanced safety and allowing a free hand for purposes of opening the door of one's automobile. The larger surface area of the top surface to accommodate the carrying handle further provides more stability to the carrier. The beverage cup carrier is a unitary mold and is capable of nesting with a plurality of similar beverage cup carriers. The top surface is attached to a peripheral rim by a plurality of annular rib components. The peripheral rim having four rounded corners at which points are positioned sockets to receive the beverage cups. The sockets extending downwardly about five inches in depth from a bottom surface containing stabilizing components within an internal wall of the sockets to provide stability by exerting an external force against the beverage container during use.

11 Claims, 4 Drawing Sheets

U.S. PATENT DOCUMENTS

| | | | | |
|---|---|---|---|---|
| D436,853 | S * | 1/2001 | Sussman | D9/755 |
| D438,100 | S * | 2/2001 | Cekota | D9/755 |
| D442,483 | S | 5/2001 | Holden | |
| D457,425 | S * | 5/2002 | Petola et al. | D9/761 |
| 6,398,056 | B1 * | 6/2002 | Letourneau et al. | 220/23.8 |
| 6,827,207 | B1 * | 12/2004 | Chen | 206/162 |
| D536,993 | S * | 2/2007 | Armstrong et al. | D9/753 |
| 7,225,927 | B2 * | 6/2007 | Sweeney | 206/564 |
| 2007/0017827 | A1 * | 1/2007 | Urquhart et al. | 206/162 |
| 2008/0088144 | A1 * | 4/2008 | Crown | 294/146 |
| 2009/0211937 | A1 * | 8/2009 | Sharma et al. | 206/515 |

* cited by examiner

BEVERAGE CUP CARRIER

PRIORITY STATEMENT

This Application claims priority to Provisional Patent Application Ser. No. 61/063,127, entitled Beverage Cup Carrier filed on Feb. 1, 2008.

BACKGROUND OF THE INVENTION

1. Field of the Invention

The field of the invention disclosed herein relates to beverage cup carriers made preferably of molded pulp or similar rigid materials for transporting beverages contained in generally any size containers. More particularly, the field of the present invention relates to disposable beverage carriers preferably composed of molded pulp capable of transporting up to four beverages contained in multiple size containers without assembly in a safe manner from tipping or spilling including a integral carrying handle ergonomically designed for enhanced safety and convenience to the user. The present invention relates to a beverage carrier disclosing a integral carrying handle from a unitary mold to accommodate carrying the beverage carrier from the top by means of the handle rather than having to carry from the side or balanced on the hand required in the prior art beverage carriers.

2. Description of the Prior Art

Beverage cup carriers are well known in the prior art. Earlier known carriers where primarily composed of cardboard that usually required assembly by the user. These prior art carriers had the disadvantage of losing stability and rigidity making them more subject to spilling or tipping of the beverage. Prior art carriers do disclose a carrying handle as an integral component, however they are composed of cardboard and have the same disadvantages.

More relevant prior art known to the applicant is the unitary molded pulp containers disclosed in U.S. Pat. No. 3,915,317 (Crabtree), U.S. Pat. No. 4,208,006 (Bixler), U.S. Pat. No. 4,218,008 (Veilleux) which disclose this use of a unitary container capable of accommodating various sizes of beverage containers and providing enhanced stability and safety from tipping or spilling. However, none of these known beverage carriers composed of molded pulp or like plastic materials contain an ergonomically shaped handle as an integral component of the carrier for enhanced safety and convenience to the user. It is an advantage of the present invention, both from a safety point of view and convenience to have the capability of carrying safely up to four beverage containers with a single hand. These prior art carriers require two hands to safely carrier four filled beverage containers and are clumsy in handling when trying to enter or exit a vehicle. The enhanced safety and convenience is provided by the unitary mold and ergonomic handle centered midline in communication with annular ribs to provide the necessary resiliency to support carrying from the top a plurality of filled beverage containers.

SUMMARY OF THE INVENTION

The present invention provides an improved disposable beverage cup carrier made of molded pulp capable of accommodating a multiple range of sizes of the containers, both tapered wall and straight containers with an integral ergonomically shaped handle for enhanced safety and use by permitting the user to carrier up to four filled beverage containers with a single hand rather than requiring both hands.

The present invention contains a wider top surface and increased depth of the sockets then disclosed in the prior art to accommodate the integral handle allowing increased stability and accommodating any size hand of different users. The present invention discloses a width and length of eleven inches by eleven inches which is within the range disclosed in U.S. Pat. No. 5,096,065 Vigue which discloses take-out windows to be generally 10½-11½ inches wide to have the advantage of ease of passing through said windows while at the same time being more resilient and convenient.

It is therefore an object of the present invention to provide a disposable beverage cup carrier with an integral carrying handle made from a unitary mold.

It is further an object of the present invention to provide a disposable beverage cup carrier consisting of an integral carrying handle to permit handling with a single hand enhancing safety from spillage and being capable of carrying filled beverages from the top of multiple sizes.

It is further an object of the present invention to provide enhanced safety as only one hand is required to carrier the beverage cup carrier leaving a free hand for other purposes like opening a car door.

It is further an object of the present invention to provide the capability of nesting of similar beverage cup carriers for efficiency in storage and shipping.

BRIEF DESCRIPTION OF THE DRAWINGS

The advantages of the present invention will become apparent to one ordinarily skilled in the art from reading of the detailed description in conjunction with the accompanying drawings, wherein like elements are numbered alike.

DETAILED DESCRIPTION

It is understood persons of ordinary skill in the art will realize that the following disclosure is illustrative only and not in any way limiting. Other embodiments of the invention herein will be readily apparent to such skilled persons having the benefit of this disclosure.

Figure 1:
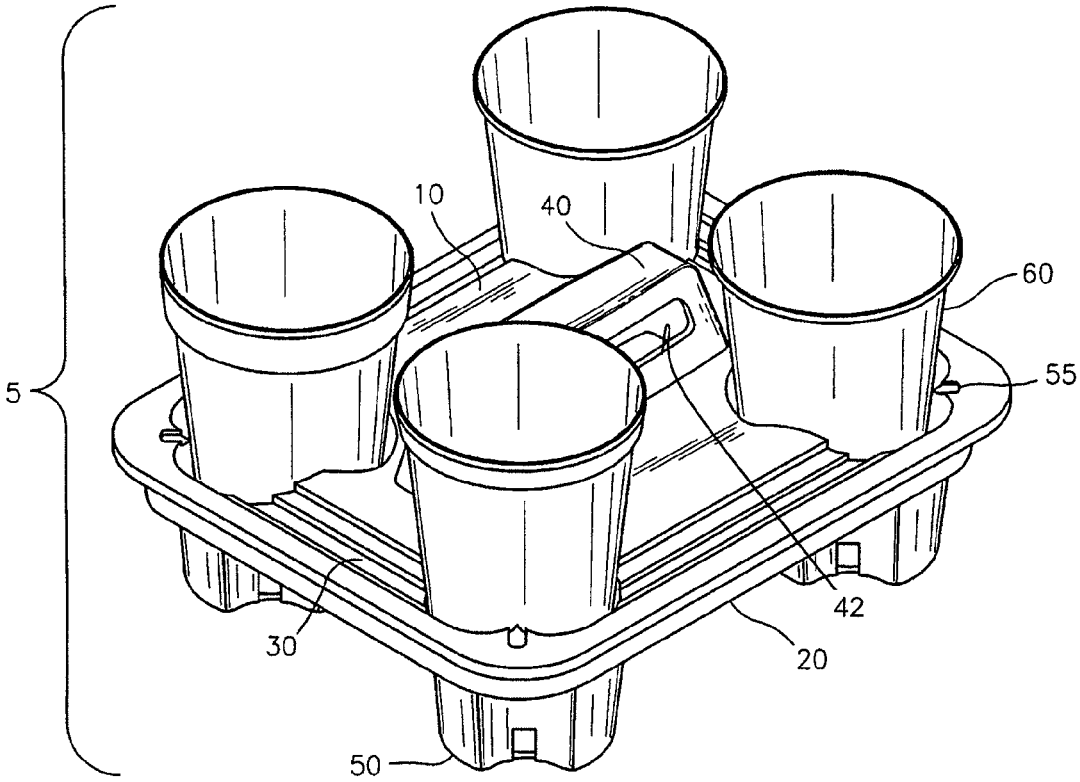
FIG. 1 is a perspective view of an exemplary embodiment of the beverage cup carrier and integral ergonomically shaped carrying handle containing four beverage containers.
Figure 2:
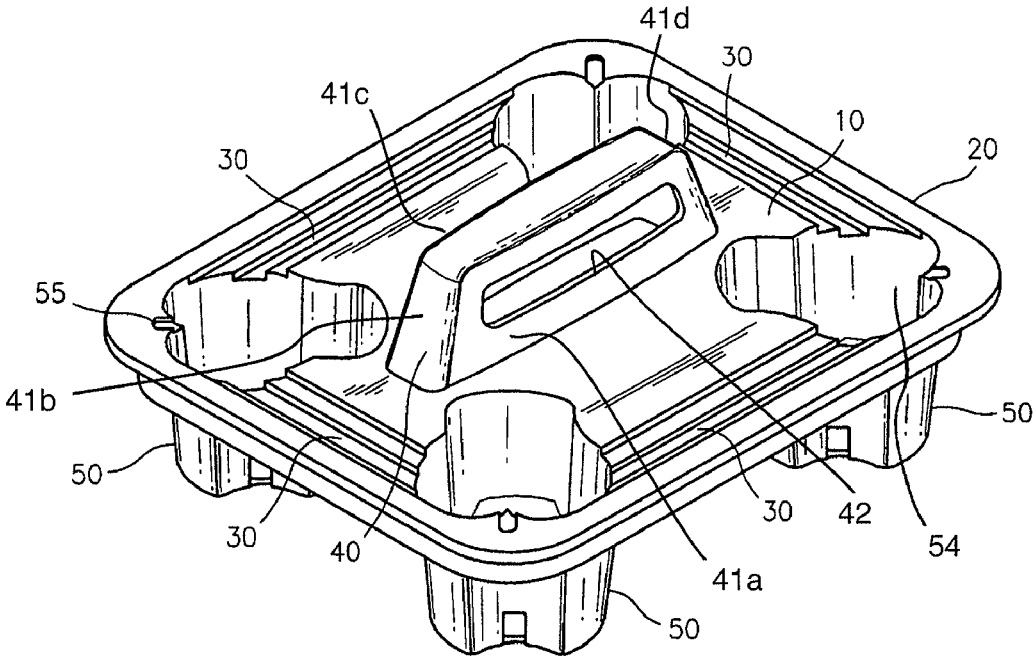
FIG. 2 is a perspective view of the beverage cup carrier without any beverage containers.
Figure 4:
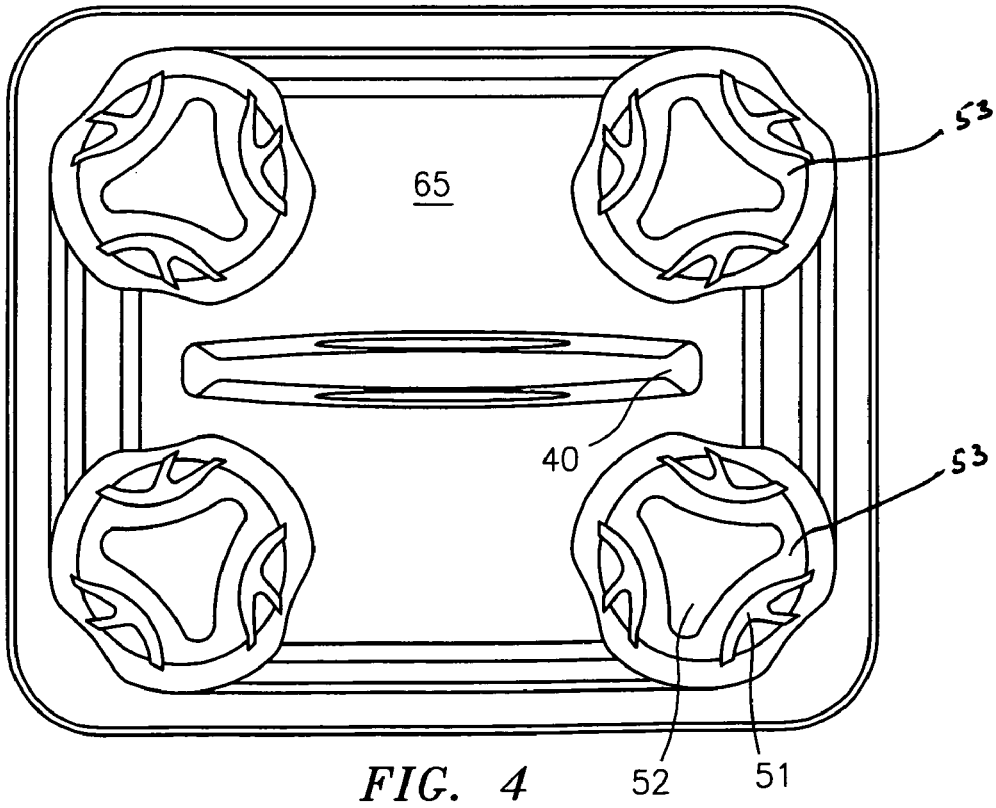
FIG. 4. is a perspective view of the bottom side of the beverage cup carrier disclosing the carrying handle being hollow for purposes of nesting with similar beverage cup carriers.

Referring to FIGS. 1 and 2 the disposable beverage cup carrier of the present invention is disclosed. A beverage cup carrier 5 capable of supporting up to four beverage containers 60 of various sizes and tapered or straight walls. The beverage cup carrier 5, generally square in shape, comprises a top surface 10 having the dimensions of approximately eleven inches by eleven inches with a peripheral rim 20. The peripheral rim 20 having four rounded edges. The beverage cup carrier further comprising a bottom surface 65 as depicted in FIG. 4. The beverage cup carrier 5 is composed of preferably molded pulp but may be substituted with a plastic or other rigid material capable of supporting up to four filled beverage containers 60.

As seen in FIG. 2, the top surface 10 consists of four sockets 50 positioned at the four corners of peripheral rim 20 and a plurality of annular ribs 30 positioned between each socket 50 providing a means of attachment of the top surface 10 to peripheral rim 20. The annular ribs 30 further providing support and rigidity to top surface 10 for accommodating beverage containers 60 preventing top surface 10 from collapsing during use.

Also depicted in FIGS. 1 and 2 is a integral ergonomically shaped carrying handle 40 positioned centrally within top surface 10. The carrying handle 40 is capable of receiving any size hand of the user and the positioning within the top surface 10 allows easy access without interfering with sockets 50 when containing beverage containers 60.

Figure 3:
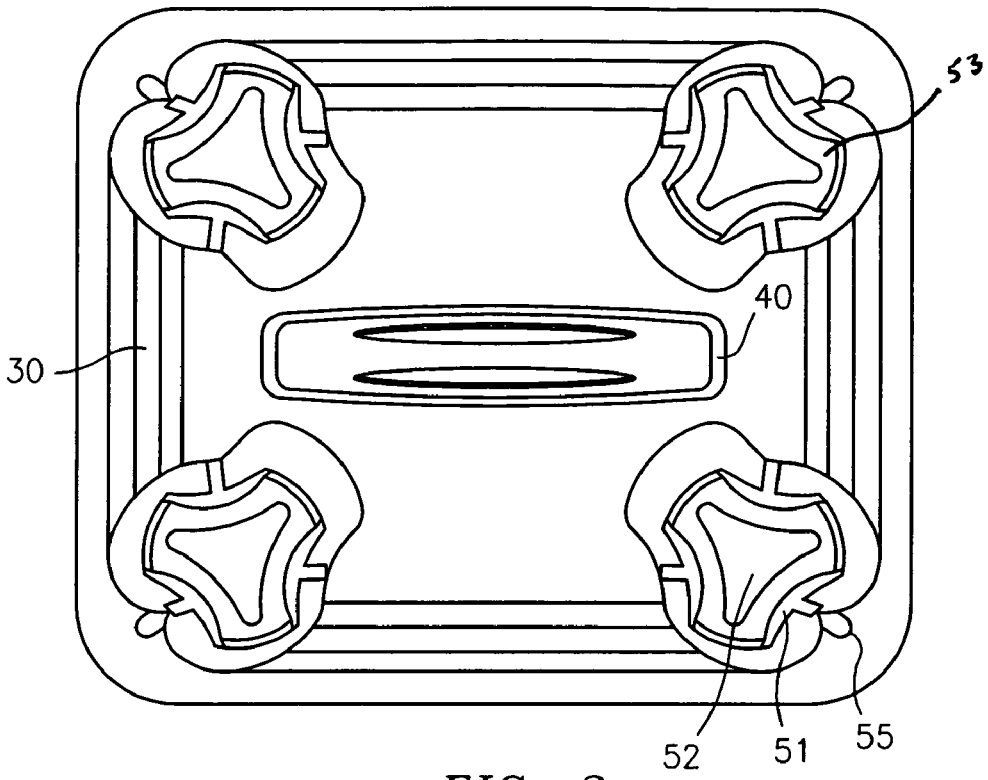
FIG. 3 is a top view of the beverage cup carrier illustrating the ergonomically shaped carrying handle and socket components.

Depicted in FIGS. 2 and 3 are illustrate the components contained within each socket 50 for accommodating various sizes of beverage containers 60. The socket 50 is composed of a base 53 and an inner stabilizing wall 54. The base 53 further consisting of a raised triangular shaped portion 52 within the confines of base 53 for accumulation of any spillage of fluids. Each socket 50 further containing at least three flexible components 51 positioned symmetrically around the inner wall 54 of socket 50. The flexible components 51 comprising a slot in the shape of an inverted "T" extending from the base 53 upwardly along inner stabilizing wall 54. With the insertion of the beverage cup 60, the plurality of flexible components 51 provide a resistant exterior force holding the beverage cup 60 in place. A stabilizing knob 55 is attached to peripheral rim 20 at central position of socket 50 provides further support and stabilization of beverage container 60. The socket 50 extends below the bottom surface 65 by a depth of approximately five inches.

Figure 5:
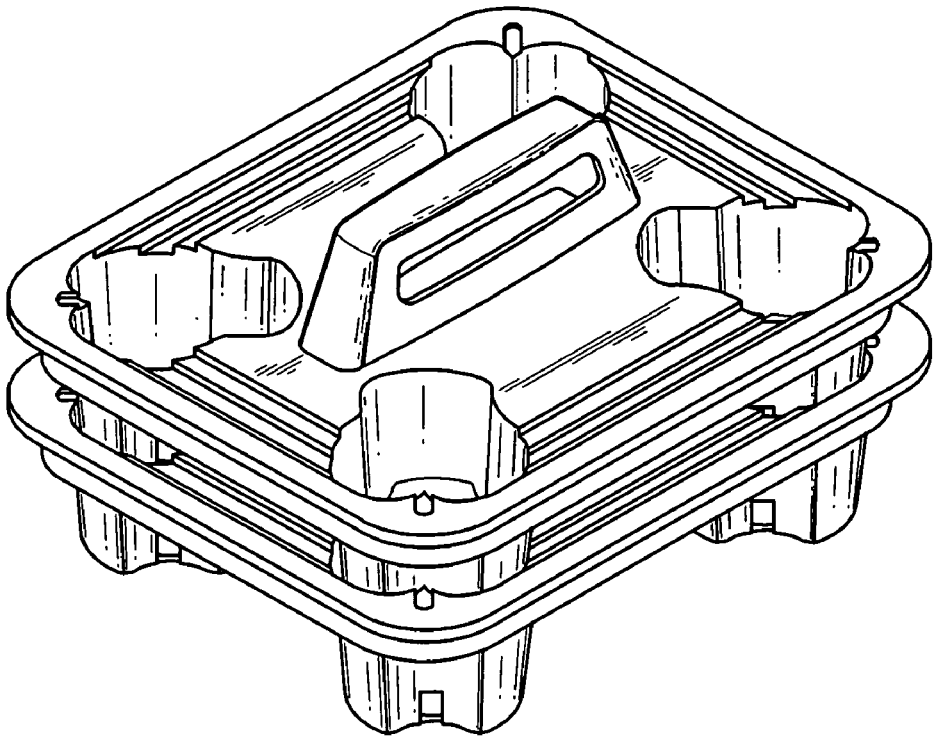
FIG. 5. is a perspective view of the beverage cup carrier and nesting with similar beverage cup containers.
Figure 6:
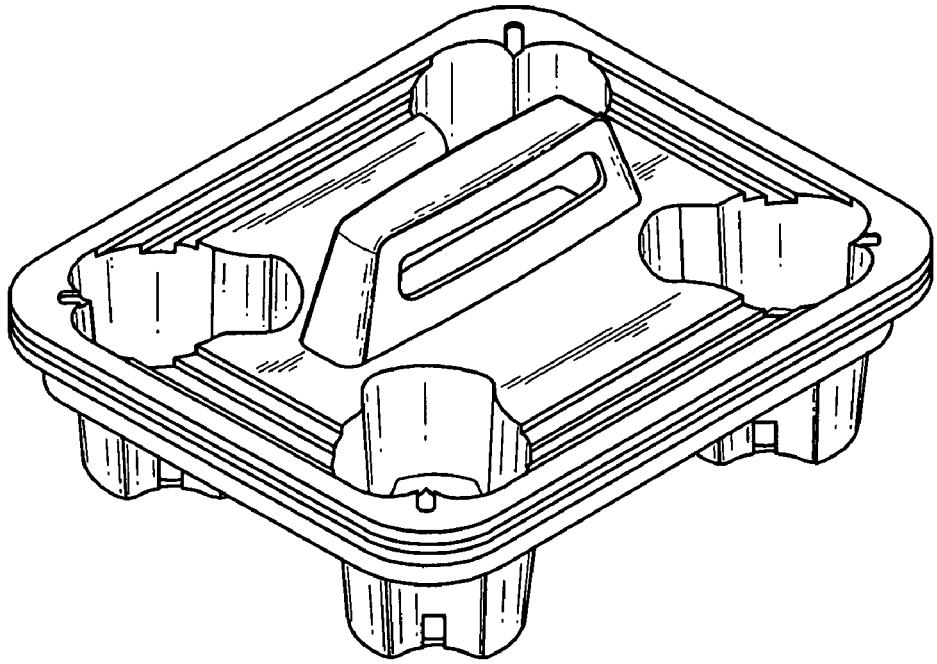
FIG. 6. is a perspective view of at least two similar beverage cup carriers nested together for efficiency in shipping and storage.

In FIG. 4. a bottom view of the embodiment of the present invention is illustrated which discloses the bottom surface 65 and the integral carrying handle 40 having a hollow inside permitting nesting of similar beverage cup carriers 5. FIGS. 5 & 6 further disclose the nesting relationship of a plurality of beverage cup containers 5.

While the invention herein has been described with reference to an exemplary embodiment, it is understood by those skilled in the art that various changes may be made and equivalents may be substituted for elements thereof without departing from the scope of the invention. Additionally, many modifications may be made to adapt a particular situation or material to the teachings without departing from the essential scope thereof. Therefore, it is intended that the invention herein not be limited to the particular embodiment disclosed as the best mode contemplated for carrying out this invention.

What is claimed is:

1. An improved beverage cup carrier integrally molded from a resilient material containing a plurality of sockets capable of accommodating different sizes of taper walled beverage container or a straight walled beverage container, said beverage cup carrier comprising:

a unitary molded top surface and a bottom surface generally square in shape having a width and length approximately eleven inches by eleven inches capable of accommodating a plurality of said beverage containers in a liquid filled state;

a peripheral rim having four rounded corners disposed about the top surface;

a plurality of sockets positioned within the four corners of the peripheral rim, said sockets being generally conical in shape and extending downward from the bottom surface at a depth of approximately five inches for accommodating a plurality of sizes of said beverage containers;

a plurality of annular ribs in a tiered configuration integral to the peripheral rim positioned symmetrically between said sockets; and a ergonomically shaped carrying handle unitary molded medially within the top surface integrally in communication with said annular ribs.

2. The beverage cup carrier of claim 1, wherein said ergonomically shaped handle is hollow internally for nesting of multiple said beverage cup carriers.

3. The ergonomically shaped handle of claim 2, wherein said handle contains a hole for gripping of said handle.

4. The beverage cup carrier of claim 1, wherein a plurality of stabilizing knobs are positioned within said peripheral rim in communication with said sockets.

5. The beverage cup carrier of claim 1, wherein the said sockets comprise:

a base having a raise triangular rib within the confines of said base;

a internal wall containing stabilizing components; and a means for exerting an external force against said beverage cup when inserted within said socket.

6. The beverage cup carrier of claim 1, wherein said resilient material is a molded pulp.

7. The beverage cup carrier of claim 1, wherein said resilient material is a plastic.

8. The stabilizing components of claim 5, wherein a plurality of inverted "T" shaped slots are positioned along said inner wall of said sockets extending downward to said base.

9. The "T" shaped slots of claim 8, wherein said slots consist of a flange component providing flexing action for accommodating said beverage cup.

10. The beverage cup carrier of claim 1, wherein a plurality of said cup carriers form a nesting relationship.

11. The beverage cup carrier of claim 1, wherein said carrier and said ergonomical handle is are formed from a unitary mold.

* * * * *